US006000204A

United States Patent [19]

Lenz

[11] Patent Number: 6,000,204

[45] Date of Patent: Dec. 14, 1999

[54] GOLF TEE MARKER MOVING SYSTEM

[76] Inventor: Jerome D. Lenz, 1262 Gambel Oaks Dr., Elizabeth, Colo. 80107

[21] Appl. No.: 09/014,932

[22] Filed: Jan. 28, 1998

[51] Int. Cl.[6] ..... A01D 34/06

[52] U.S. Cl. ..... 56/16.9; 56/7

[58] Field of Search ..... 56/1, 6, 7, 249, 56/294, 11.9, 12.7, 15.2, 16.9; 414/618, 740, 550

[56] References Cited

U.S. PATENT DOCUMENTS

| | | | |
|---|---|---|---|
| 2,387,087 | 10/1945 | Hoist | 212/66 |
| 2,831,589 | 4/1958 | Way | 214/147 |
| 3,926,316 | 12/1975 | Luttrell | 212/59 R |
| 4,663,920 | 5/1987 | Skovhoj | 56/12.7 |
| 4,893,455 | 1/1990 | Hughes | 56/1 |
| 5,000,648 | 3/1991 | Hosking | 414/618 |
| 5,211,526 | 5/1993 | Robinette | 414/550 |
| 5,244,338 | 9/1993 | White | 414/740 |

*Primary Examiner*—Robert E. Pezzuto
*Attorney, Agent, or Firm*—Haugen Law Firm PLLP

[57] ABSTRACT

A golf tee marker moving assembly is positioned on the front of a conventional tees mower with a universal mount. The moving assembly includes a pivoting lift arm and a golf tee marker capture assembly located at the free end of the pivoting lift arm. The pivoting arm is coupled to a motor mounted on the universal mount and is controlled by a manual switch to raise or lower the pivoting arm. The motor is coupled to the mower battery. A tee marker with a base and spherical top, separated from the base with a neck, is adapted to be captured by the golf tee marker capture assembly. Once captured, the tee marker is raised out of the path of the mower by pivoting the arm upward. The mower operator can then remove the tee marker from the golf tee marker capture assembly, mow the tee area and then replace the tee marker.

13 Claims, 9 Drawing Sheets

GOLF TEE MARKER MOVING SYSTEM

BACKGROUND OF THE INVENTION

I. Field of the Invention

This invention relates to a moveable arm assembly that can be mounted on a conventional golf course mower, and more particularly to a moveable arm that lifts golf tee markers out of the path of the mower thereby permitting the operator to remove and replace the golf tee markers without leaving or stopping the mower while mowing the tees.

II. Discussion of the Prior Art

Golf course grounds keepers work diligently to keep the course in exceptional playing condition. Part of the maintenance includes mowing the tees every day or every other day. The mowing operation includes removing the tee markers at the tee boxes located at the beginning of each hole, mowing the area where the tee marker was removed and then replacing the tee marker in its proper location. The current method requires the average operator to get on and off the mower approximately 100 times to remove and then replace the tee markers. Such a task is time consuming and burdensome.

In an attempt to shorten the mowing time, flexible markers have been developed, such as that disclosed in U.S. Pat. 4,893,455 to Hughes. Such markers are positioned on a flexible shaft that bends as the mower passes over the marker. However, repeated flexing damages the markers over time. Furthermore, the grass surrounding the flexible marker may not be cut evenly, an undesirable result in golf course management.

A need, therefore, exists for a less time consuming, but effective, way of mowing a tee box. Furthermore, a device that can be readily adapted to conventional mowers would be beneficial and cost effective. The present invention uses a pivoting arm for moving the tee markers out of the mower path and up to the mowing operator. Thus, the mowing operator is able to remove and replace the tee markers without having to stop and leave the mower.

SUMMARY OF THE INVENTION

The present invention is a golf tee marker moving system for use on a conventional tees mower. An arm is mounted onto the mower with a mount universally adapted to conventional mowers. The arm is selectively moveable between a first position and a second position. A golf tee marker capture assembly is located on a free end of said arm. The operation uses a control means for positioning the arm between a first position and a second position. In the first position the arm is lowered such that the golf tee marker can be captured by the capture assembly as the mower proceeds towards the tee marker. In the second position, the arm is raised upward so the mowing operator can remove the tee marker from the capture assembly without leaving the mower seat.

Thus, the primary object of the present invention is to provide a system for removing and replacing golf tee markers during the mowing operation without requiring the operator to stop and get off the mower each time a tee marker must be removed or replaced.

Another object of the present invention is to provide an efficient and cost effective system for removing and replacing tee markers during a mowing operation that is readily mounted to a conventional mower.

A further object of the present invention is to provide a a system for removing and replacing tee markers that is positionable on either side of the mower and height adjustable to thereby accommodate the variety of conventional commercial mowers currently used by golf course grounds keepers.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
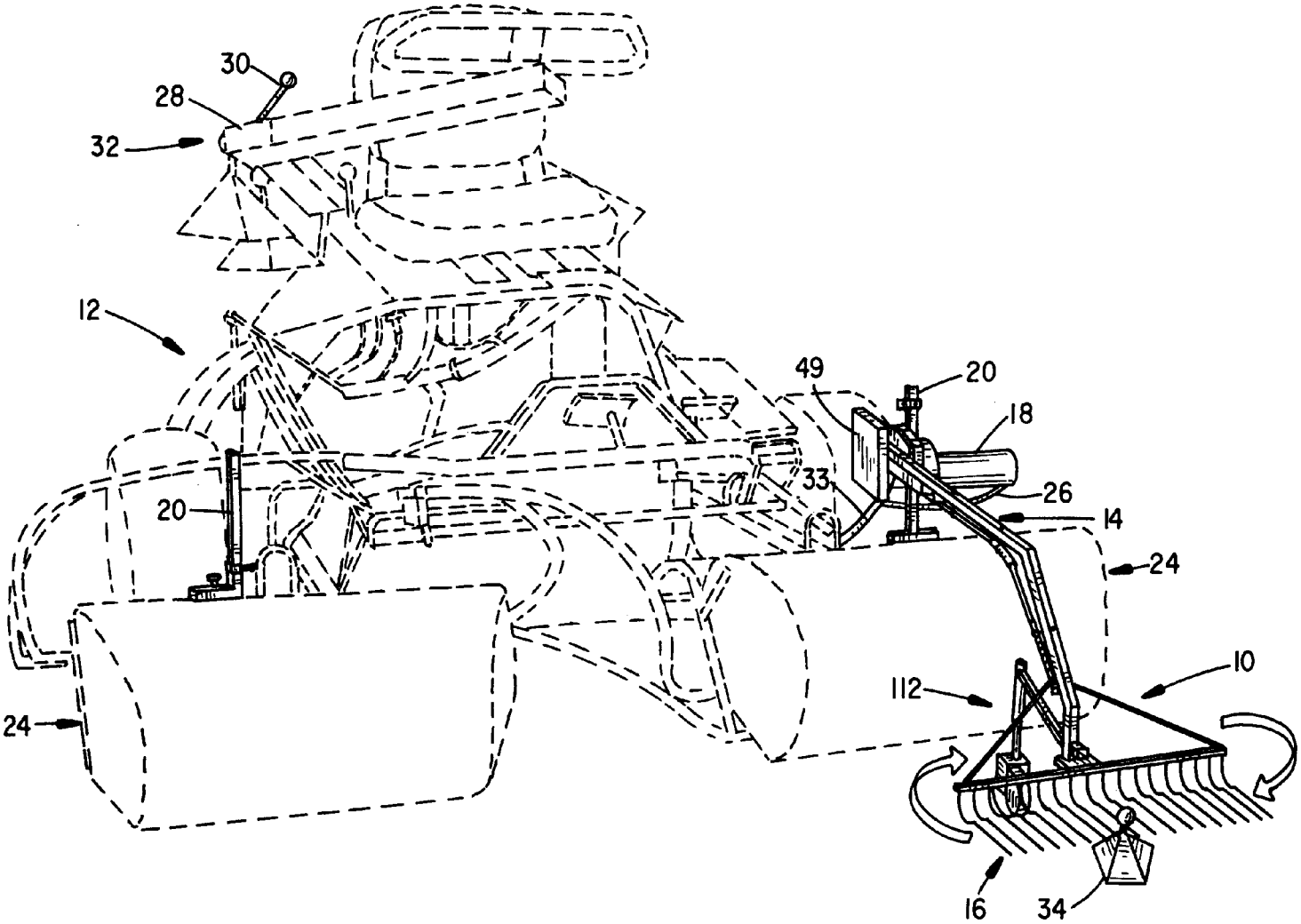
FIG. 1 is a perspective view of the present invention mounted on the right side of a conventional tees mower along with a golf tee marker used with the present invention.

The golf tee marker moving apparatus of the present invention is shown in FIG. 1, designated generally as 10, mounted on the right side of a conventional tee mower 12. The golf tee marker apparatus 10 includes a pivoting arm assembly 14, a golf tee marker capture assembly 16 and a motor 18 secured to a universal mount 20. The universal mount 20 is secured to a bar (not shown) above the cutting blade and grass catcher assembly 24 on the conventional mower 12. Motor 18 is operatively coupled to the mower's battery (not shown but typically a 12V battery) by cord 26. A manual switch box 28 having a switch 30 for operating the golf tee marker moving apparatus 10, is conventionally secured adjacent the mower's controls 32. The switch box 28 is coupled to the motor through cord 33. The golf tee marker moving apparatus 10 is used to lift tee markers such as the pentagonal shaped tee marker 34 shown in FIGS. 1, 9 and 10.

Figure 2:
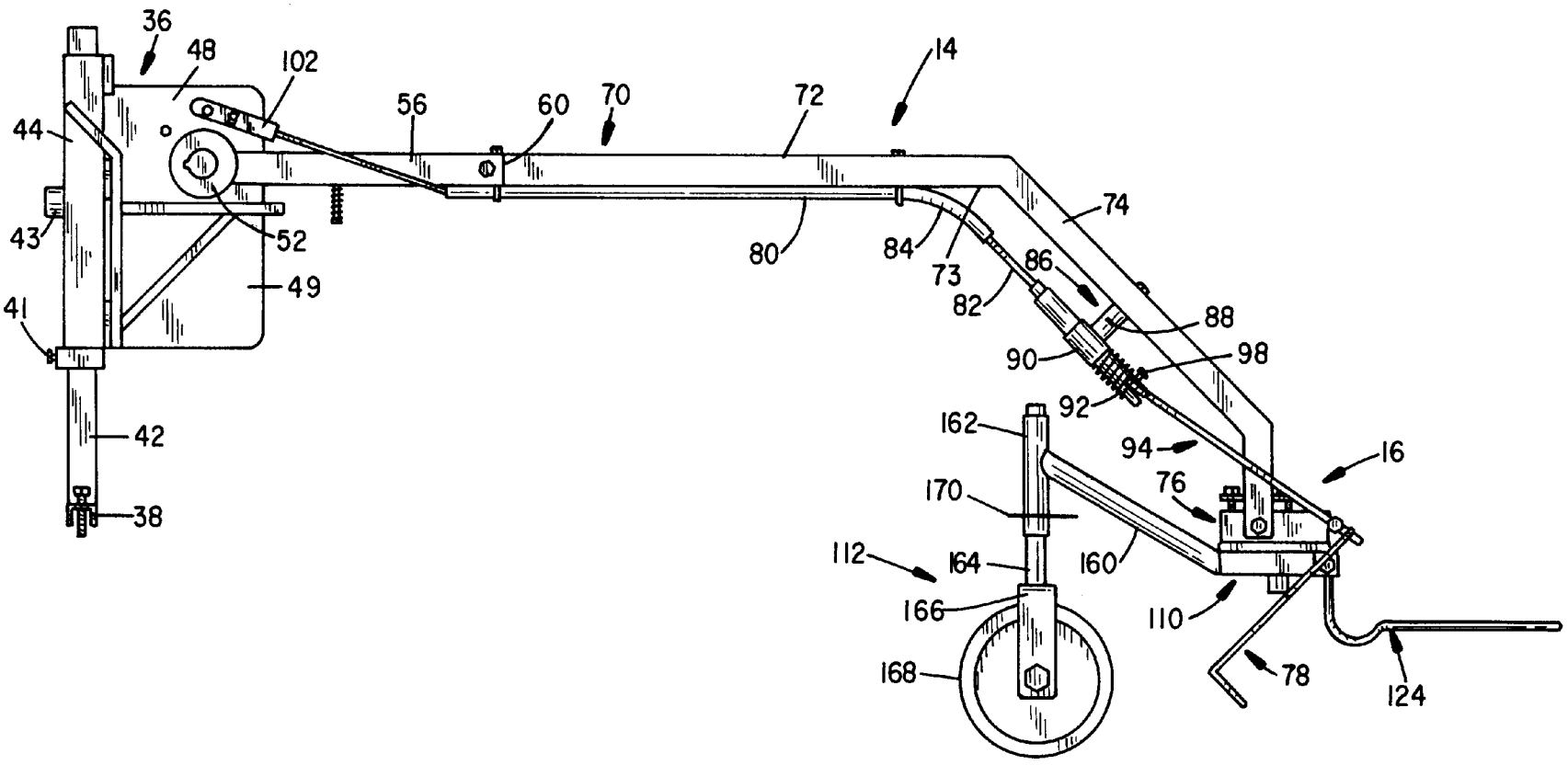
FIG. 2 is a side view of the present invention for the left side of a conventional mower, with the motor and the gear reduction box removed.
Figure 3:
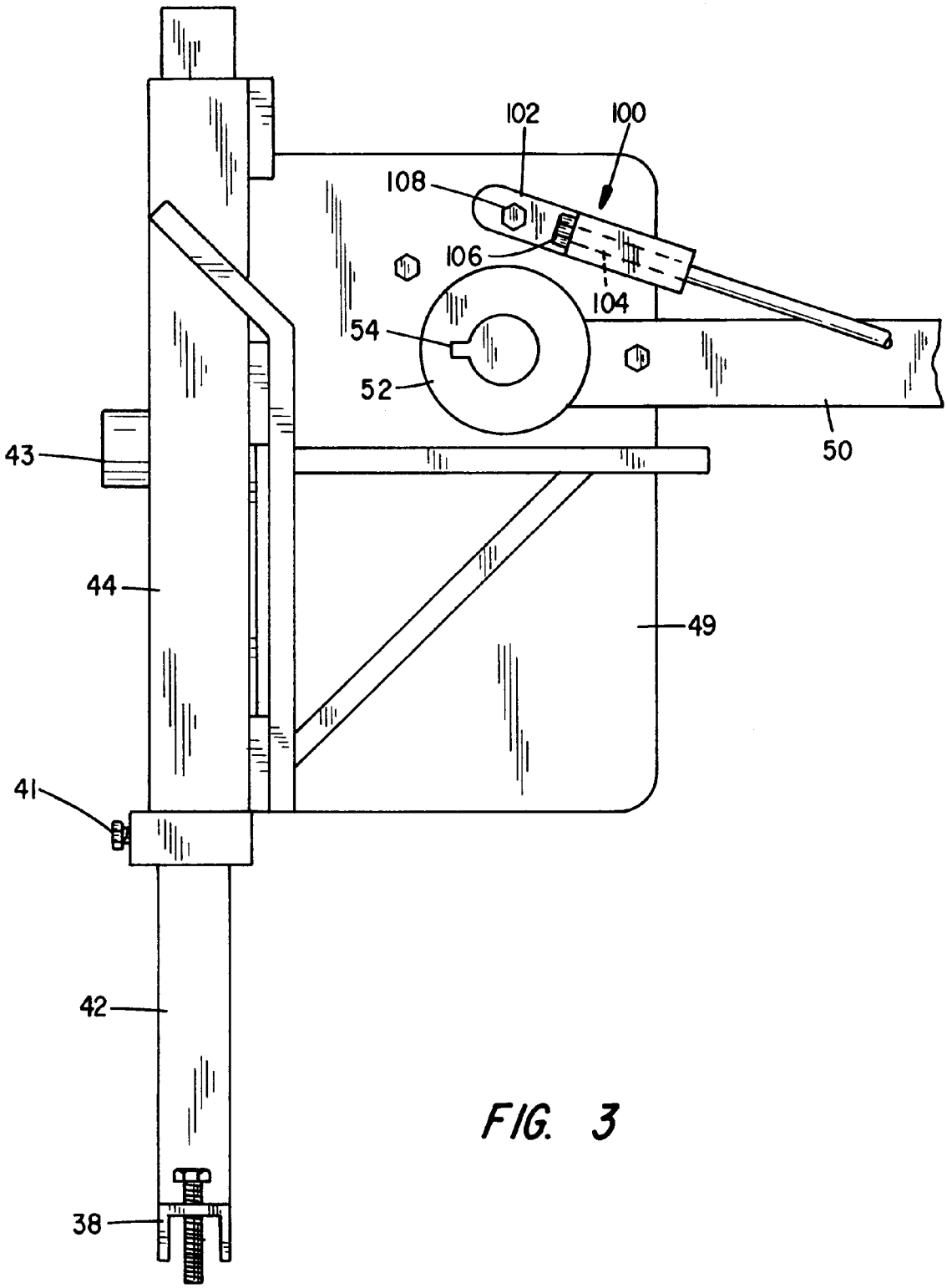
FIG. 3 is an enlarged view of a portion of the universal mount and motor mount assembly shown in FIG. 2.
Figure 4:
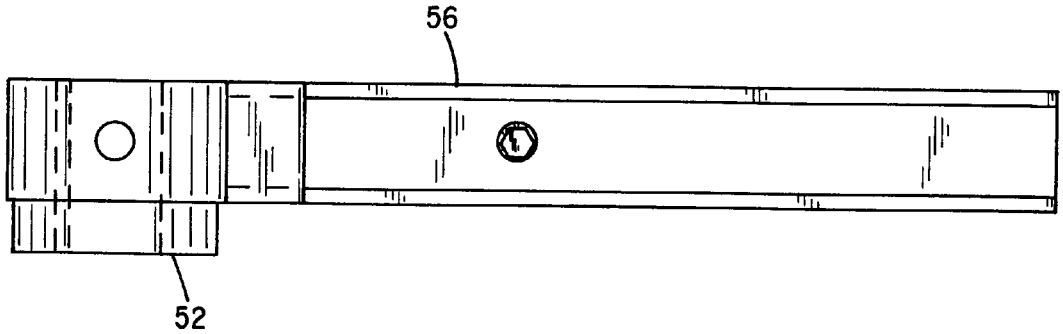
FIG. 4 is a top view of the pivot arm mount of the present invention.
Figure 10:
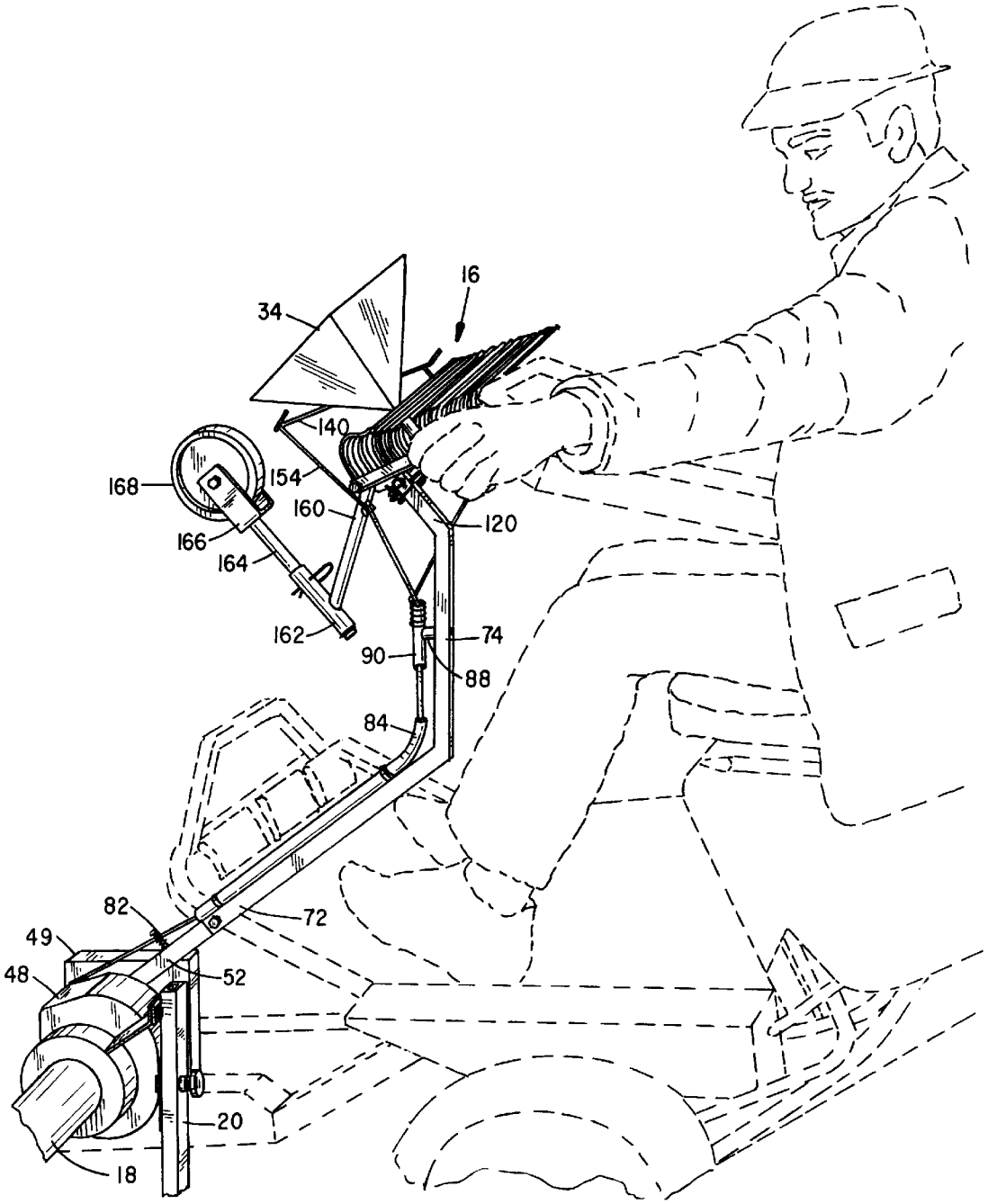
FIG. 10 is a side view of the present invention holding the golf tee marker in a raised position.

Turning now to FIGS. 1, 2 and 3, the universal mount 20 and the motor mount assembly 36 are shown in greater detail. Universal mount 20 has a channel member 38 that is secured with conventional fasteners to a bar above the cutting blade and grass catcher assembly 24 on a conventional mower 12 as seen in FIG. 1. The channel The member 38 is preferably sized 1.00×0.50×0.125 (Channel A36) which allows it to be readily adaptable to any conventional mower bar. Extending transverse to the channel member 38 is a tubular member 42 that is preferably 0.75×0.75 Tubing, (11 gauge A36). A sleeve 44 of the motor mount assembly 36 receives the tubular member 42 therein. Motor mount assembly 36 is fastened to the tubular member 42 at the desired height with conventional fasteners, such as shown at 41 and 43. The motor 18 and gear reduction box 48 are bolted to the motor mount assembly 36 as seen in FIGS. 1 and 10. The gear reduction box 48 is preferably a 267:1 gear reduction and the motor is preferably 1/15 HP. Alternatively, as can be seen by one of skill in the art, a hydraulic motor that is operatively connected to the hydraulic system of conventional mowers may be used.

Figure 5:
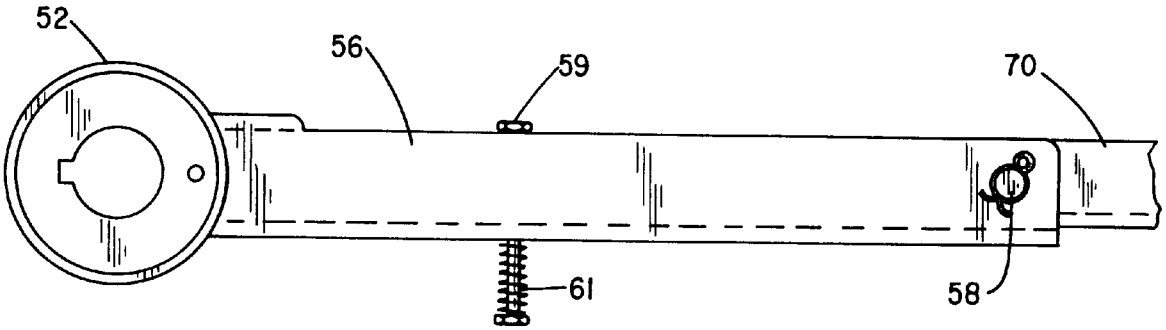
FIG. 5 is a side view of the pivot arm mount of the present invention.

A pivot arm mount 50 is coupled to the gear shaft (not shown) and supports the pivoting lift arm assembly 14. As seen in FIGS. 1, 2, 4 and 5, the pivot arm mount 50 has a hub 52 positioned between the gear box 48 and end plate 49. The gear shaft (not shown) is secured to the with a conventional key arrangement (not shown) that fits into the key seat 54 as seen in FIGS. 2 and 5. A channel 56 that receives pivot arm 70 of the pivoting lift arm assembly 14 extends from the hub 52, as seen in FIGS. 1 and 2. The pivot arm 70 is secured in the sleeve with a pivot pin 58 and a bolt 59 and spring 61. With such a fastening arrangement, The pivot arm essentially floats in the channel 56, enabling it to carry the weight of the golf tee marker capture assembly 16 and golf tee marker 34.

Figure 6:
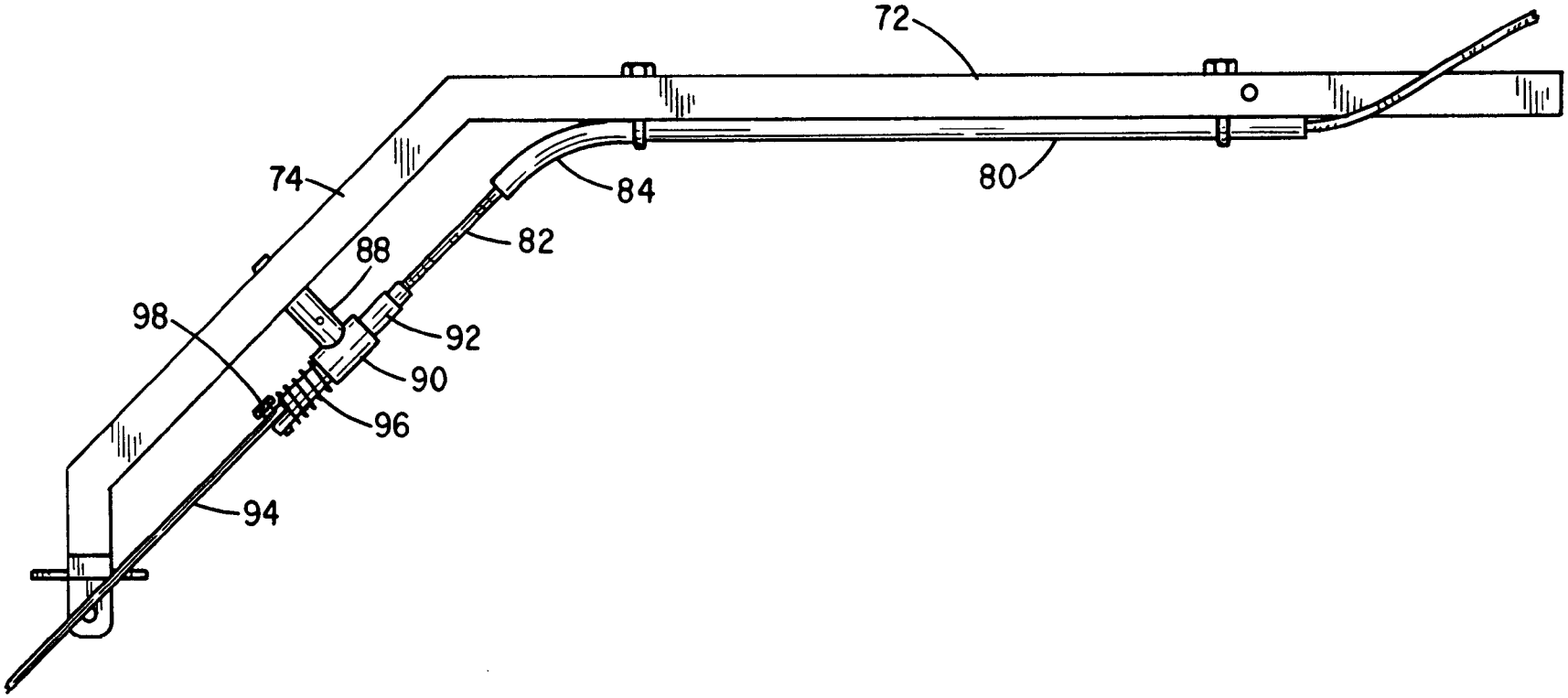
FIG. 6 is a side view of the pivot arm and cable assembly of the present invention.

Turning now to FIGS. 1, 2 and 6, the pivot arm 70 includes a horizontal length 72 and an angled length 74 that extends down towards the ground surface where it supports the golf tee marker capture assembly 16. The horizontal length 72 extends sufficiently past the cutting blade assembly and grass catcher basket 24 of conventional mowers 12, preferably approximately 18.50 inches from end 60 of the pivot arm mount 48. At the end of the angled length 74 is a pivot mount 76 for the golf tee marker capture assembly 16 and a stabilizer bar assembly 78 which will be describe later in greater detail.

Extending along the lower surface 73 of the horizontal length 72 of the pivot arm 70 is a tubular member 80 for receiving a cable 82 therethrough. Just prior to the angled length 74, the tubular member 80 ends with an arcuate portion 84 that is spaced away from the angled length 74 as seen in FIGS. 1, 2 and 6. The cable 82 passes through the arcuate portion 84 and terminates at a cable and tie rod mount 86. Tie rod mount 86 is located on the lower surface 85 of angled length 74 and includes a support member 88 and a tubular member 90 transverse to the support member 88. Cable 82 is fastened to a bar 92 that extends through the tubular member 90. Bar 92 is fastened at its opposite end to a tie rod assembly 94. A spring 96 surrounds bar 92 between the tubular member 90 and a pivot pin 98 securing the tie rod assembly 94 to bar 92. Cable end 100 is mounted to the motor housing 48 with bar 102. Bar 102 has a bore 104 through which cable 82 extends and is secured with a fastener 106. A pivot pin 108 secures bar 102 to the housing 48. As will be explained in greater detail in the description of the operation of the invention, bar 92 moves freely within tubular member 96 and the cable 82 moves freely within the tubular member 80.

Figure 7:
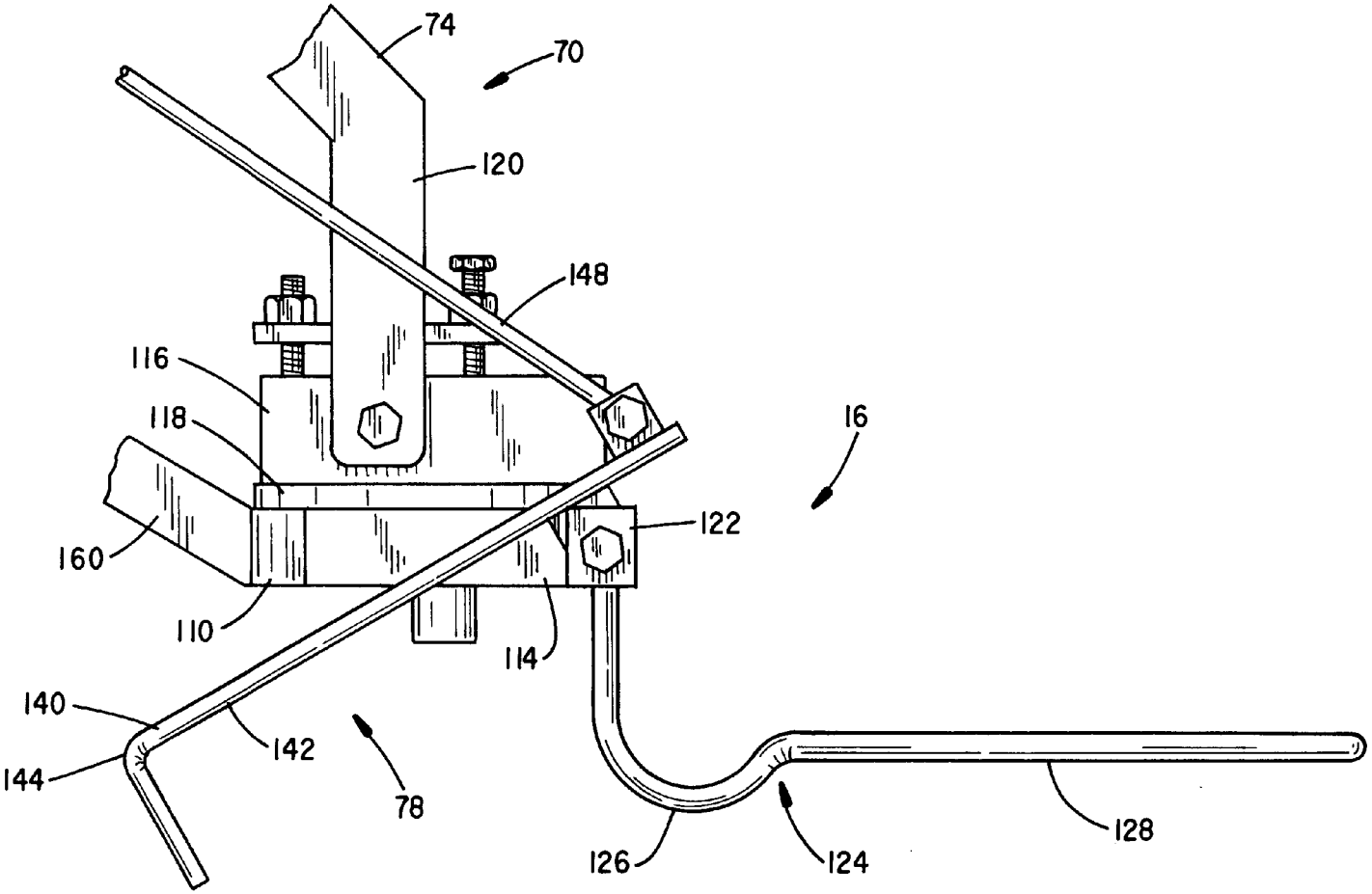
FIG. 7 is view of pivot base and tine assembly of the present invention.
Figure 8:
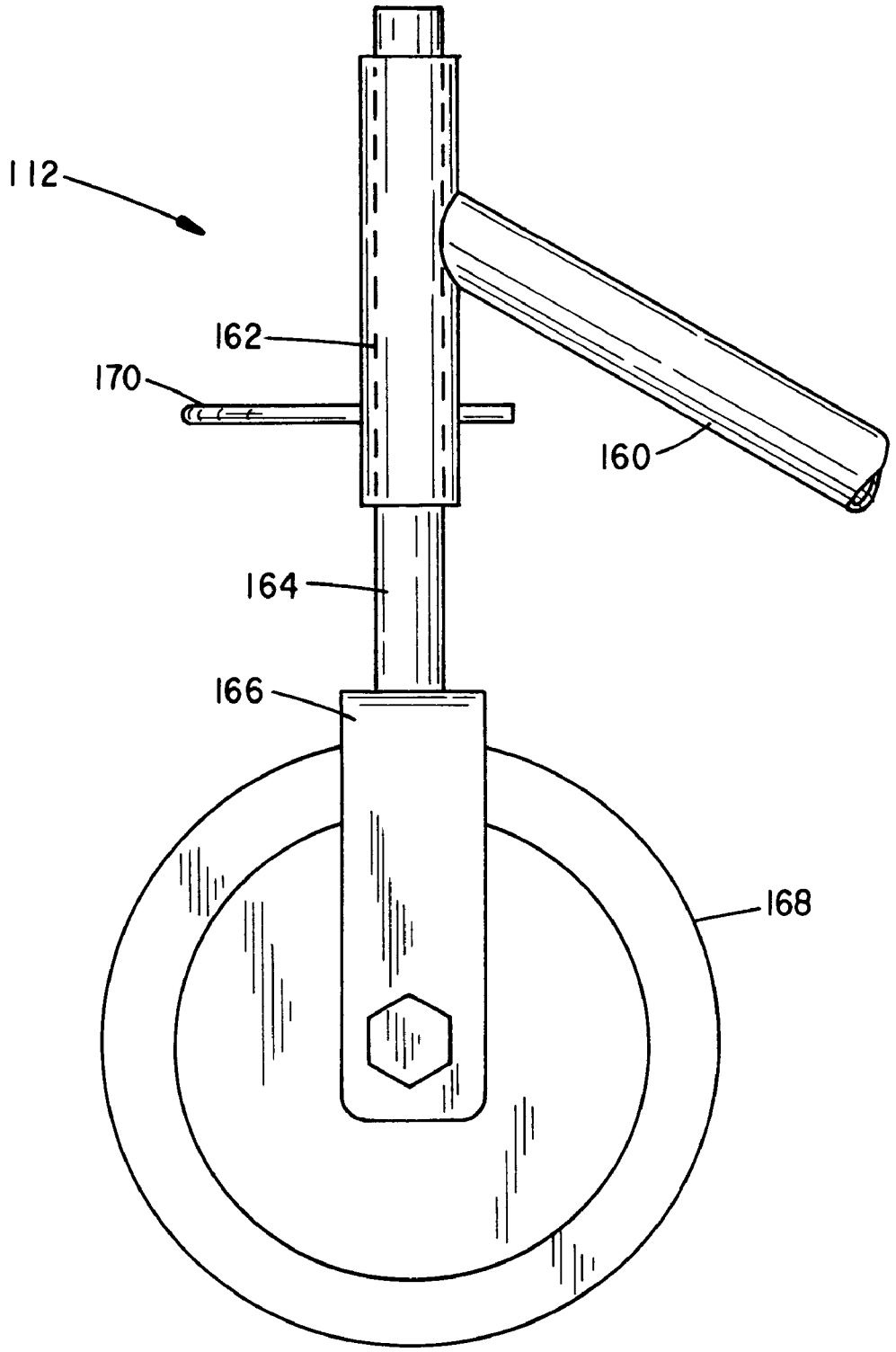
FIG. 8 is side view of the pivot base and wheel assembly of the present invention.

Turning now to FIGS. 1, 2, 7 and 8, the pivot base 110, tee marker capture assembly 16, stabilizer bar assembly 78 and wheel assembly 112 will be described. The pivot base 110 includes plate 114 that supports the pivot mount 116. Pivot mount 116 houses an annular member mounted for rotation (not shown). The base 118 of the annular member is fastened to plate 114, such that the pivot base 110 will rotate 30 degrees to the right or left with the annular member. The pivot arm 70 is linked to the pivot mount 116 through link 120, such that the pivot arm 70 does not rotate with the pivot base 110. Extending from the plate 114 is the tine bar 122 that supports a plurality of tines forming the tee marker capture assembly 16. As seen in FIGS. 1, 2 and 7, tine 124 has a depending arcuate portion 126 and a lateral end portion 128. The arcuate portion 126 is sized to conform to the spherical portion 130 of the tee marker 34 seen in FIGS. 1, 9 and 10. The spacing of the tines are sufficient to receive the neck 134 of the tee marker 34 therethrough. The tee marker 34 and tee marker pick-up assembly 16 are specifically configured to mate as shown. However, any other suitable mating arrangement between a tee marker and capture assembly can be used.

The stabilizer bar assembly 78 includes a stabilizer bar 140 extending along the width of the tine assembly 16 and positioned beneath the pivot mount 116. A first side bar 142 extends from end 144 over tine bar 122 to position just in front of the tine bar 122 where it is linked to tie rod side 148. Likewise, support bar 150 extends from end 152 over the tine bar 122 to position in front of the tine bar where it is linked to tie rod side 154. Tie bar sides 148 and 154 extend up to the tie rod mount 86 where the tie rod assembly 94 is pivotally linked to the bar 90.

Pivot base 110 includes an angled bar 160 extends back to support sleeve 162 receiving wheel bracket bar 164. Bracket bar 164 extends from bracket 166 in which wheel 168 is journaled for rotation therein. The wheel 168 is preferably four inches by one and a half inches and made of a suitable material such as polyolefin. The bracket bar 164 and support sleeve 162 have a plurality of holes (not shown) through which a pin 163 can extend to secure the wheel 166 to the support sleeve 162 when two selected holes are aligned. The wheel height can be adjusted by aligning the appropriate holes to achieve the desired height and inserting pin 163.

The operation of the apparatus will now be described. The grounds keeper first mounts universal mount 20 on bar 22. The grounds keeper can select either to use the invention on either the right or left side of the mower. The motor 18, gear box 48 and pivot arm 70 are mounted to the universal mount 20, the motor 18 is attached to the battery and the switch box 28 is placed adjacent the mower operation controls 32. Certain mowers may require the motor 18 to be mounted on the inboard side of the mount arrangement because of the mower's configuration. Thus, a mirror image of the mount shown in FIG. 1, 9 and 10 can be readily adapted to place the motor 18 on the inboard side of the universal mount 20. These figures show the right side tee marker moving apparatus 10. The device for the left side is an exact mirror image of the right side, and can be readily adapted from this disclosure and the left hand side motor mount and pivot arm assembly 14 shown in FIGS. 2 and 3 by one of skill in the art.

Figure 9:
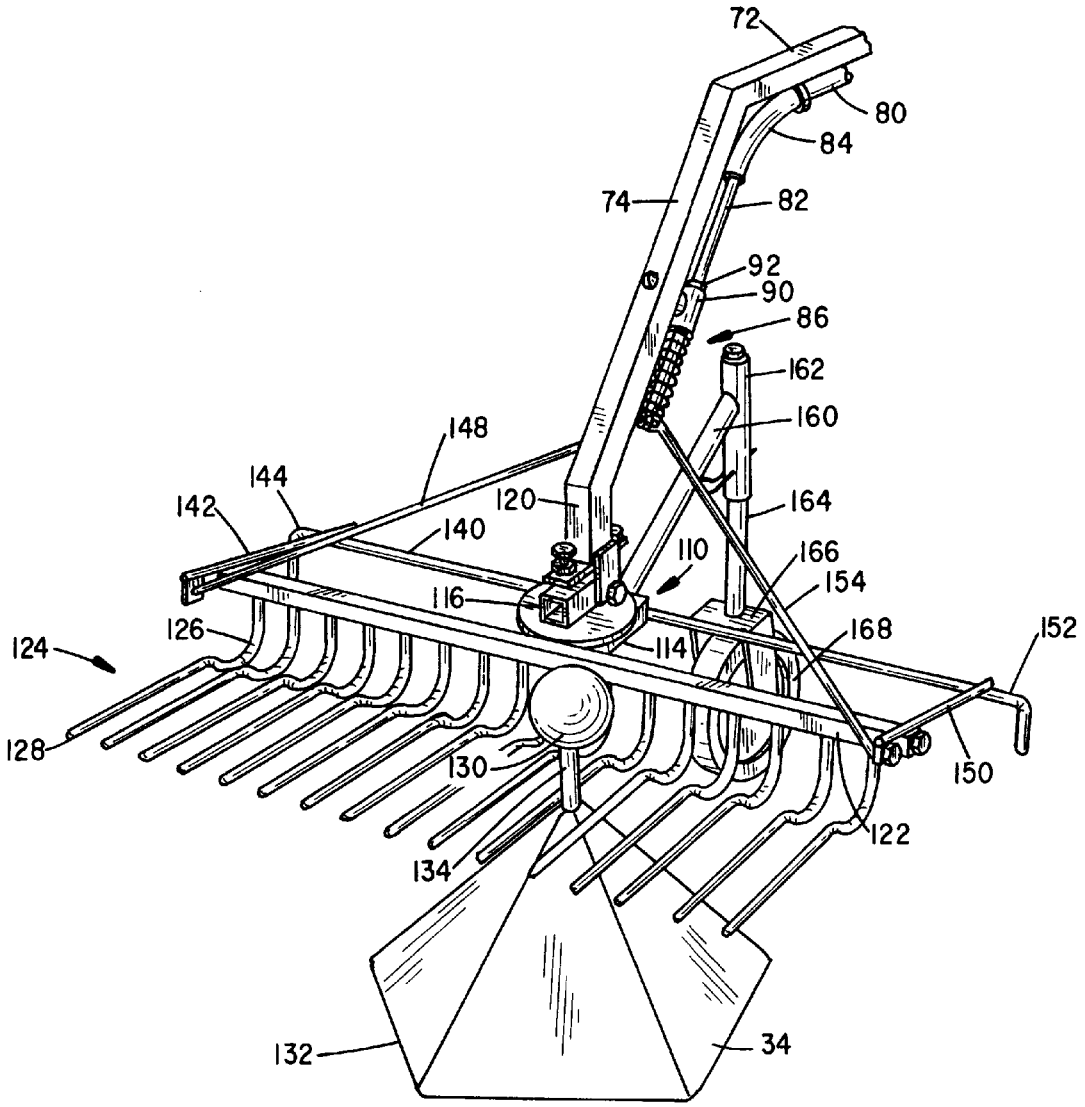
FIG. 9 is a side view of the present invention first engaging the golf tee marker.

The greens keeper now begins the mowing operation with the pivot arm 70 extended in its down position as in FIGS. 1 and 9. As the mower 12 turns, the pivot base 110 allows the wheel 168, tine bar assembly 116 and stabilizer bar assembly 78 to turn with the mower 12. As the operator approaches a tee box, the operator aligns the tine bar assembly 116 and captures the tee marker 34 between two tines as shown in FIG. 9. As the tee marker is captured, it may be dragged along the ground a short distance. Angled bar 160 of the pivot base 110 provides the necessary clearance. The operator then switches on the motor 46 to raise the pivot arm 70 to the second position shown in FIG. 10. As the pivot arm 70 swings up, the cable 82 causes the stabilizer bar 140 to swing up further to support the tee marker base 134. The operator then manually removes the tee marker 34 and drops it in place as the mower 12 passes by the proper location on the tee. The operator can then proceed with the mowing operation without having to stop and get off the mower 12 to remove tee markers before mowing and then replace tee markers after mowing.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A golf tee marker moving system for use on a conventional greens mower, said golf tee marker moving system comprising:

a) an arm selectively moveable between a first position for engaging, releasably capturing, and lifting said tee marker upwardly and a second position elevated from said position for hand-gripping delivery to the operator of said greens mower;

b) a mount securing said arm to said conventional greens mower;

c) a golf tee marker capture assembly on a free end of said arm for engaging and releasably capturing a golf tee marker; and d) control means for positioning said arm between said first and second positions.

2. A golf tee marker moving system of claim 1 wherein said golf tee marker capture assembly comprises:

a) a golf tee marker mating member configured for capturing said golf tee marker; and b) a golf tee marker stabilizer bar positioned adjacent said golf tee marker mating member for supporting said golf tee marker captured in said golf tee marker mating member as said arm is moved from said first position to said second position.

3. A golf tee marker moving system of claim 1 wherein said golf tee marker capture assembly is pivotally connected to said arm.

4. A golf tee marker moving system of claim 1 and further including said control means connected to a power source of said conventional mower.

5. A golf tee marker moving system of claim 1 wherein said mount selectively secures said arm at a desired height relating to ground.

6. A golf tee marker moving system of claim 1 wherein said mount is positionable on either side of said conventional mower.

7. A golf tee marker moving system for use on a conventional greens mower, said golf tee marker moving system comprising:

a) an arm selectively moveable between a first position for engaging, releasably capturing, and lifting said tee marker upwardly and a second position elevated from said position for hand-gripping delivery to the operator of said greens mower;

b) a mount securing said arm to said conventional greens mower;

c) a golf tee marker capture assembly on a free end of said arm for engaging and releasably capturing a golf tee marker;

d) control means for positioning said arm between said first and second positions;

e) wherein said golf tee marker capture assembly comprises:

1) a golf tee marker mating member configured for capturing said golf tee marker; and 2) a golf tee marker stabilizer bar positioned adjacent said golf tee marker mating member for supporting said golf tee marker captured in said golf tee marker mating member as said arm is moved from said first position to said second position; and 3) a wheel supporting said golf tee marker capture assembly.

8. A golf tee marker moving system of claim 7 wherein said wheel is height adjustable.

9. A golf tee marker moving system for use with a conventional golf course mower having a power source, a cutting blade and grass catcher assembly and a golf tee marker having a neck and a spherical top, said golf tee marker moving system comprising:

a) an arm moveable between a first position and a second position, said arm having a first end and a second end;

b) a mount at said second end of said arm for mounting said arm adjacent said cutting blade and grass catcher assembly of said mower;

c) a golf tee marker capture assembly pivotally coupled on said first end of said arm, said golf tee marker capture assembly including a plurality of tines;

d) a wheel extending from said golf tee marker capture assembly, said wheel engaging ground when said arm is in said first position;

e) a golf tee marker stabilizer bar extending from said golf tee marker capture assembly;

f) a cable extending along said arm, said cable having a first end coupled to said golf tee marker stabilizer bar and a second end coupled to said mount for moving said stabilizer bar between a first position and a second position when said arm is moved between said first position and said second position;

g) a control means coupled to said mower power source, for controlling the movement of said arm between said first position and said second position.

10. The golf tee marker moving system of claim 9 wherein said mount includes a channel member and a transverse member.

11. A golf tee marker moving system of claim 10 wherein said arm is selectively mounted on said transverse member at a desired height.

12. A golf tee marker moving system of claim 9 wherein said mount includes a channel for receiving said arm and said arm is pivotally mounted to said channel.

13. The golf tee marker moving system of claim 9 wherein said plurality of tines are spaced to accommodate said neck of said golf tee marker between two adjacent tines.

* * * * *